US010807829B2

(12) United States Patent
Dunn

(10) Patent No.: US 10,807,829 B2
(45) Date of Patent: Oct. 20, 2020

(54) REINFORCED WOOD FIBER CORE

(71) Applicant: Souhegan Wood Products, Inc., Wilton, NH (US)

(72) Inventor: Randolph A Dunn, Wilton, NH (US)

(73) Assignee: Souhegan Wood Products Inc., Wilton, NH (US)

( * ) Notice: Subject to any disclaimer, the term of this patent is extended or adjusted under 35 U.S.C. 154(b) by 0 days.

(21) Appl. No.: 15/704,798

(22) Filed: Sep. 14, 2017

(65) Prior Publication Data

US 2018/0072532 A1 Mar. 15, 2018

Related U.S. Application Data

(60) Provisional application No. 62/394,427, filed on Sep. 14, 2016.

(51) Int. Cl.

| | |
|---|---|
| ***B32B 3/00*** | (2006.01) |
| ***B65H 75/02*** | (2006.01) |
| ***B65H 75/10*** | (2006.01) |

(52) U.S. Cl.

CPC ..... *B65H 75/02* (2013.01); *B65H 75/10* (2013.01); *B65H 2701/5112* (2013.01); *B65H 2701/5116* (2013.01)

(58) Field of Classification Search

CPC .... B32B 1/02; B32B 1/08; B32B 7/12; B32B 21/02; B32B 21/04; B32B 21/06

See application file for complete search history.

(56) References Cited

U.S. PATENT DOCUMENTS

| | | | |
|---|---|---|---|
| 503,227 | A | 8/1893 | Benham |
| 1,015,244 | A | 1/1912 | Parker |
| 1,753,342 | A | 4/1930 | Hubbard |
| 1,881,911 | A | 10/1932 | Parker |
| 2,365,980 | A | 12/1944 | Thomas |
| 2,748,805 | A | 6/1956 | Winstead |
| 2,977,066 | A | 3/1961 | Kimmel |
| 3,447,996 | A | 6/1969 | Himmelheber et al. |
| 3,807,458 | A | 4/1974 | Royston |
| 4,034,932 | A | 7/1977 | Ferch |
| 4,157,181 | A | 6/1979 | Cecka |
| 4,166,432 | A | 9/1979 | Moore |
| 4,179,269 | A | 12/1979 | Yates et al. |

(Continued)

FOREIGN PATENT DOCUMENTS

| | | |
|---|---|---|
| EP | 605914 A1 | 7/1994 |
| EP | 747205 A2 | 12/1996 |

(Continued)

OTHER PUBLICATIONS

Bushblock Fuel Logs Help the Cheetah's Cause, CCF Bush Party, Ltd., retrieved online <www.cheetah.org/?nd=ccf_bush_Project>, retrieved on Oct. 1, 2010, 5 pages.

(Continued)

*Primary Examiner* — Elizabeth E Mulvaney

(74) *Attorney, Agent, or Firm* — Maine Cernota & Rardin

(57) ABSTRACT

A winding core with improved beam and hoop strength and diminished friability and method for manufacturing such a core are provided, the winding core comprising: an extruded wood fiber core member; and at least one preformed paper shell member having a split seam parallel to its major axis, the shell being adhered to an exterior surface of the extruded wood fiber core member and a secondary shell of wooden staves.

12 Claims, 5 Drawing Sheets

(56) References Cited

U.S. PATENT DOCUMENTS

| | | | |
|---|---|---|---|
| D255,664 | S | 7/1980 | Wahl |
| 4,361,530 | A | 11/1982 | Peer |
| 4,391,898 | A | 7/1983 | Van der Velden |
| 4,701,373 | A | 10/1987 | Fuchs et al. |
| 4,810,255 | A | 3/1989 | Fay, III et al. |
| 4,980,214 | A | 12/1990 | Charriere |
| 5,147,722 | A | 9/1992 | Koslow |
| 5,165,543 | A | 11/1992 | Heyda |
| D345,930 | S | 4/1994 | Lewis |
| 5,585,155 | A | 12/1996 | Heikkila et al. |
| 6,007,656 | A | 12/1999 | Heikkila et al. |
| 6,083,601 | A | 7/2000 | Prince et al. |
| 6,106,944 | A | 8/2000 | Heikkila et al. |
| 6,319,457 | B1 | 11/2001 | Ducharme, Jr. et al. |
| D532,714 | S | 11/2006 | Scharr |
| 7,270,279 | B2 | 9/2007 | Monk |
| 7,357,726 | B2 | 4/2008 | Thorning |
| D581,568 | S | 11/2008 | Bertken |
| D670,156 | S | 11/2012 | Crooks |
| D676,170 | S | 2/2013 | Feng |
| D780,115 | S | 2/2017 | Huang |
| 9,777,891 | B2 | 10/2017 | Kawabata |
| D813,155 | S | 3/2018 | Yamada |
| D833,492 | S | 11/2018 | Stevens |
| 2002/0066824 | A1 | 6/2002 | Floyd |
| 2002/0094431 | A1 | 7/2002 | Roderick et al. |
| 2002/0106178 | A1 | 8/2002 | Bumgerner |
| 2004/0126515 | A1 | 7/2004 | Yarmoska |
| 2005/0015986 | A1 | 1/2005 | Stebnicki et al. |
| 2005/0049329 | A1 | 3/2005 | Faulkner |
| 2005/0133951 | A1 | 6/2005 | Muller et al. |
| 2006/0262518 | A1 | 11/2006 | Thuma |
| 2008/0156234 | A1 | 7/2008 | van de Camp |
| 2009/0110842 | A1 | 4/2009 | Vinden et al. |
| 2009/0145994 | A1 | 6/2009 | Dunn |
| 2009/0264560 | A1 | 10/2009 | Warnes |
| 2010/0236172 | A1 | 9/2010 | Wirth |
| 2011/0177265 | A1 | 7/2011 | Dunn |

FOREIGN PATENT DOCUMENTS

| | | | |
|---|---|---|---|
| EP | 1250995 | A1 | 10/2002 |
| GB | 723426 | A | 2/1955 |
| GB | 901519 | A | 7/1962 |
| GB | 1471181 | | 4/1977 |
| JP | 08-090691 | | 4/1996 |
| JP | 11-309704 | | 11/1999 |
| JP | 2000-034802 | | 2/2000 |
| JP | 2002-115701 | | 4/2002 |

OTHER PUBLICATIONS

FM200 Floor Back and Side Wrap, retrieved online <www.cheaponsale.com/d-p11216434113935>, retrieved on Oct. 1, 2010, 3 pages.

Office Action for U.S. Appl. No. 12/328,800, dated Dec. 28, 2009, 8 pgs.

Office Action for U.S. Appl. No. 12/328,800, dated Jul. 21, 2010, 6 pgs.

PCT Search Report dated Sep. 29, 2011 of Patent Application No. PCT/US2011/021675 filed Jan. 19, 2011.

Penta Profiles Furniture Components, retrieved online <www.pentaprofiles.com/about-us.htm>, retrieved on Oct. 1, 2010, 1 page.

Belt-Winding Cores—entire industries revolve around them: Metal End Caps, Reinforcement for repeated use, posted unknown, [retrieved Oct. 15, 2019]. Retrieved from Internet, <URL: http://souheganwood.com/products/belt-winding-cores/>.

REINFORCED WOOD FIBER CORE

RELATED APPLICATIONS

This application claims the benefit of U.S. Provisional Application No. 62/394,427, filed Sep. 14, 2016. This application is herein incorporated by reference in its entirety for all purposes.

FIELD OF THE INVENTION

The invention relates to extruded wood fiber winding cores, and more particularly, to an extruded wood fiber winding core equipped with a rigid paperboard coating reinforced by staves.

BACKGROUND OF THE INVENTION

Wood fiber cores are used to support rolls of various materials. Its limited beam strength and durability, however, have hindered its adoption in some industries like industrial belt winding, were the significant weight of the material wound about a core has traditionally been considered to require a steel core. Such steel cores are custom welded geographically close to the place where they will be used since they are bulky and awkward to transport. They are thus very costly.

Other industries, like light weight high tech non-woven materials have rejected such cores due to the friability of the wood fiber material. Dislodged material may damage the non-woven textile.

What is needed, therefore, are techniques for producing a light weight, non-friable, industrial core with a smooth exterior and high beam strength.

SUMMARY OF THE INVENTION

One embodiment of the present invention provides a winding core, the winding core comprising: an extruded wood fiber core member; at least a first paper shell member the shell member being adhered to an exterior surface of the extruded wood fiber core member and; a shell layer comprising a plurality of wood staves disposed around the external circumference of the first paper shell member.

One embodiment of the present invention provides a method for manufacturing a winding core, the method comprising: providing an extruded wood fiber core member having an external diameter; splitting a paper tube along a line parallel to the tubes major axis, the tube having an interior diameter less than the external diameter of the extruded wood fiber core member; applying an adhesive to the extruded wood fiber core member; opening the paper tube along the line and placing the paper tube around the extruded wood fiber core member; clamping the tube to the extruded wood fiber core member and allowing the adhesive to cure.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
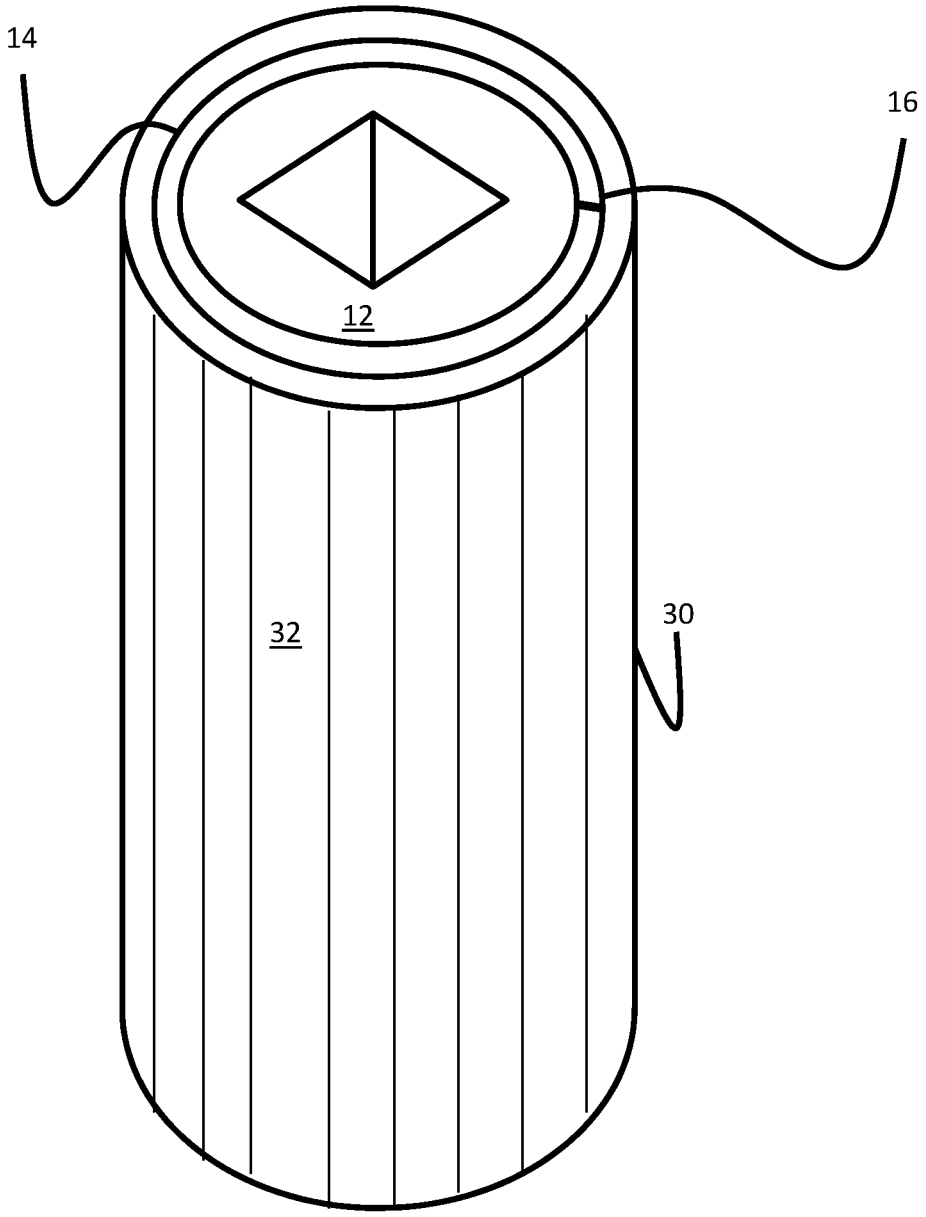
FIG. 1 is a perspective view illustrating a reinforced winding core configured in accordance with one embodiment of the present invention.

In one embodiment of the present invention, as illustrated in FIG. 1, a wood fiber winding core 12 is provided such as those that have been manufactured by the applicant's company since 1963. In such an embodiment, a shell 14 may be applied to the winding core 12. The shell 14 of one such embodiment comprises a preformed cylindrical cardboard shell or shell of laminated paper. The shell is split 16 along at least one side to allow placement over the core 12. In some embodiments, a plurality of splits 16 may be present. In one embodiment of the present invention, the inside diameter of the external shell is slightly smaller than the exterior diameter of the core to which it is applied such that there are no gaps between the exterior of the core and the interior of the shell once applied. A secondary shell 30 of solid wood is disposed around said shell 14. The secondary shell 30 is configured from wood staves 32 affixed to the core 12 and shell 14 with glue and or mechanical fasteners like brads or nails.

Figure 2:
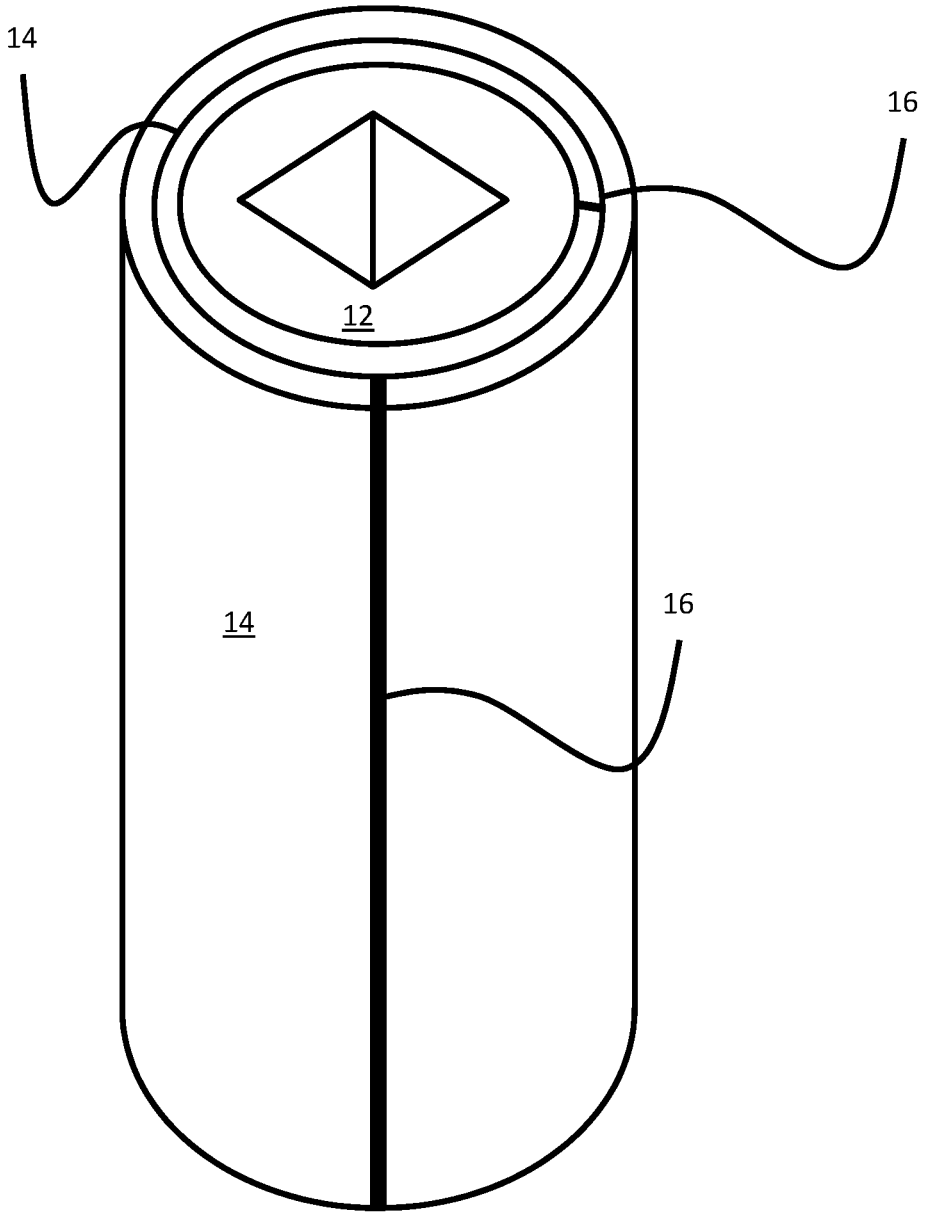
FIG. 2 is a perspective view illustrating a reinforced winding core configured in accordance with one embodiment of the present invention having a multilayer shell with 90° out of phase seams.
Figure 3:
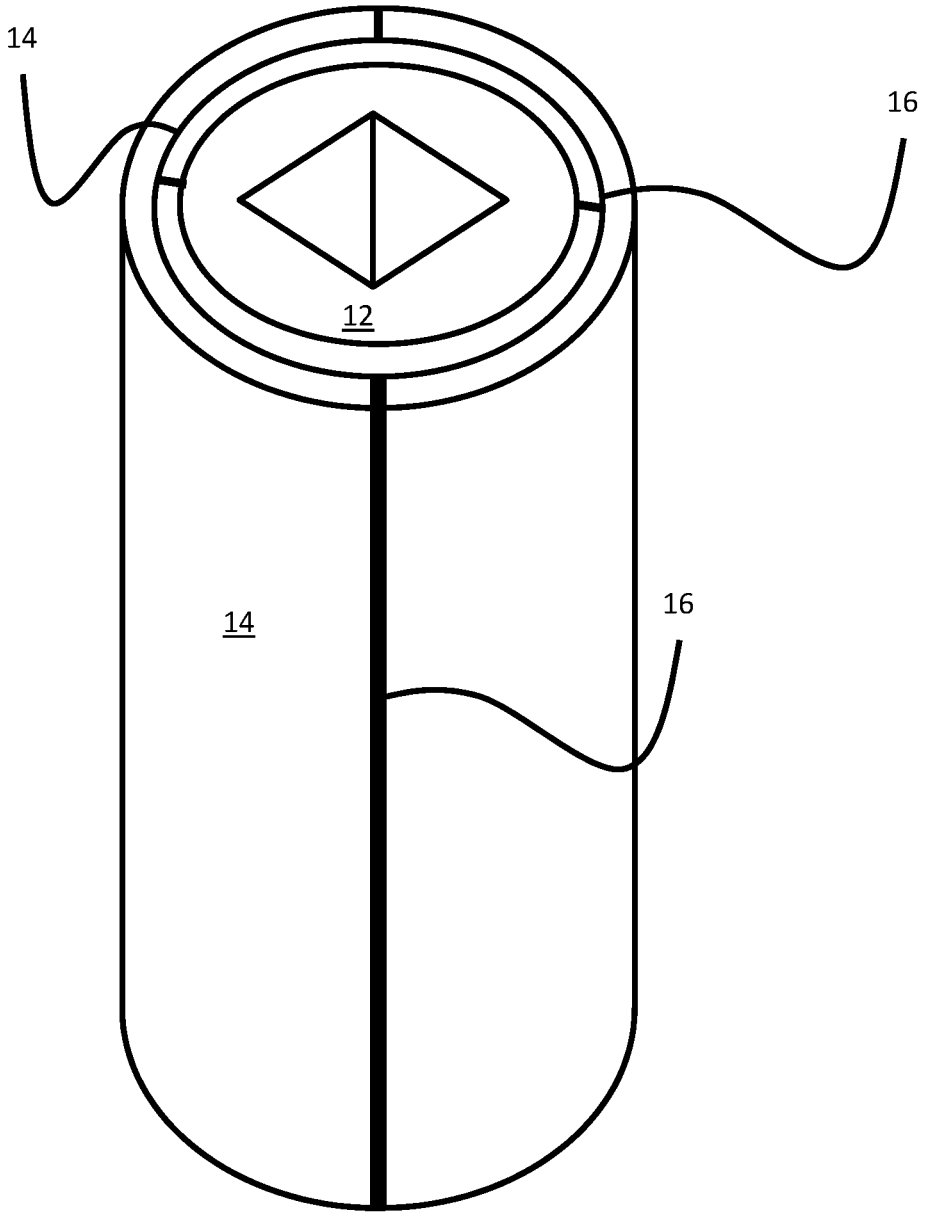
FIG. 3 is a perspective view illustrating a reinforced winding core configured in accordance with one embodiment of the present invention having a multilayer shell with 180° out of phase seams.
Figure 4:
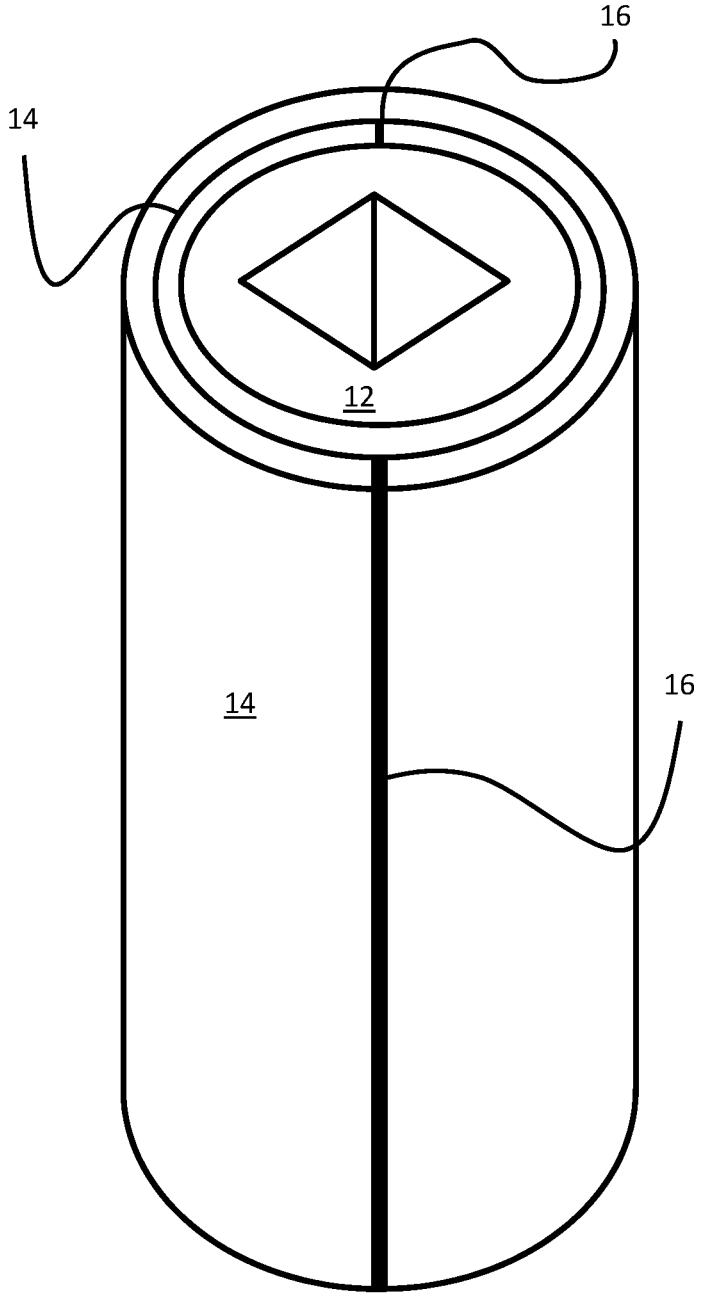
FIG. 4 is a perspective view illustrating a reinforced winding core configured in accordance with one embodiment of the present invention having a multilayer shell with 180° out of phase seams

The external shell 14 of one embodiment of the present invention, is, as discussed above, configured from paper laminate, comprising layers of liner board that have been wound and formed into a cardboard like material. Examples of such tubes include those used to pour cement columns and footings. The thickness of the tubes may vary depending on the application, but in one embodiment may be approximately $^{90}/_{1000}$ inch to $^{200}/_{1000}$ inch. Multiple layers of tubes may be applied to provide greater thickness of shells, in some instances up to $^{500}/_{1000}$ inch to $^{600}/_{1000}$ inch. In such embodiments with multiple layers increases in strength are seen in embodiments with staggered seams. The embodiments with greater demands for hoop strength would be provided with seams that are 180° out of phase as in FIG. 4, while those with greater need for beam strength would have seams 90° out of phase as in FIG. 2. The secondary shell 30 may be disposed outside of these additional layers of paper laminate. Alternatively, as in FIG. 3, more than one split 16 may be made in each tube to allow for greater ease of manufacture.

The shell may in some embodiments be affixed to the exterior of the core through glue or other chemical fastener. In one embodiment, wood glue is used. It has been found that embodiments using higher viscosity glues work well as they fill gaps in the extruded core. In other embodiments the core can be submersed in a bath of thinner bodied glue or resin to permeate the surface of the core and then the shell is applied. Alternative adhesives, such as epoxies or contact cements, may be used in various embodiments.

In embodiments using glues as adhesives, one or more may be applied to the exterior of the shell. Clamps may be used to hold the assembly together during manufacture. The clamps may take the form of a plurality of hose clamps, a compressed air bag system, or a single vacuum bag enclosing the glued unit until the adhesive sets. An even pressure on the exterior of the shell is, according to one embodiment, used.

Figure 5:
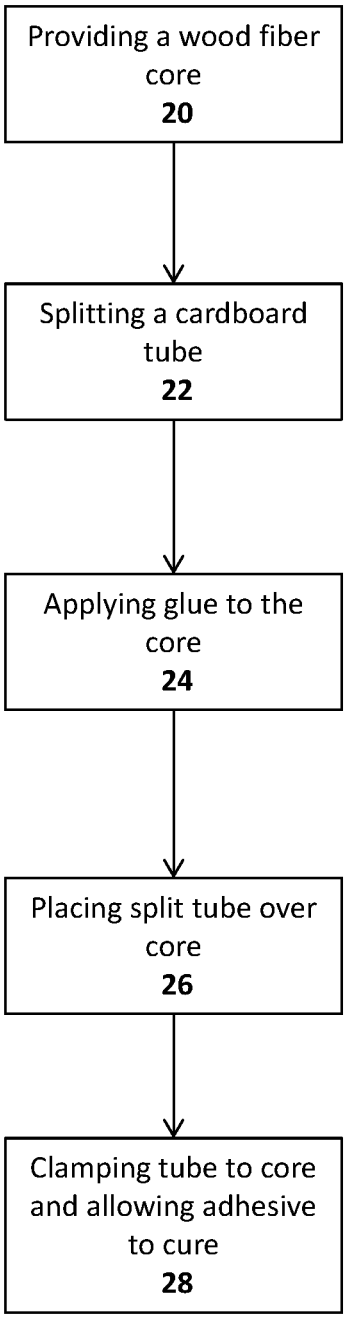
FIG. 5 is a flow chart illustrating method for manufacturing a reinforced winding core configured in accordance with one embodiment of the present invention.

A method for manufacturing a winding core configured according to one embodiment of the present invention is illustrated in FIG. 5. A wood fiber core is provided having a cylindrical exterior cross profile and an interior axial aperture and extruded wood fiber body 20. A cardboard tube manufactured from a series of layers of linerboard is split along at least one side 22. The splitting of the cardboard tube may be done using sheers, knives, or other means by which a smooth, non-frayed edge cut is obtained. In other embodiments, more than one split may be made to facilitate application of stiffer tubes. The split tubes are configured to have an internal diameter that is smaller than the exterior diameter of the core. This may be achieved by selecting a tube for splitting which already has a smaller interior diameter, or removing material from the cut, thereby decreasing the internal diameter of the tube. Glue or other adhesive is applied to the core. 24 The split tube is then opened, applied, and disposed around the glued core and closed. 26 Clamps or other pressure devices are applied to the exterior of the tube to hold it securely in place until the adhesive cures. 28

The applicant has found that the application of a cardboard or paper tube to the exterior of a wood fiber core member yields a unit with high beam strength and minimal friability.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto

I claim:

1. A winding core, the winding core comprising:

An extruded wood fiber core member;

At least a first paper shell member said shell member being adhered to an exterior surface of said extruded wood fiber core member and;

A wooden shell layer comprising a plurality of wood staves disposed around the external circumference of said first paper shell member.

2. The winding core of claim 1 further comprising a second paper shell member disposed between said first paper shell member and said wooden shell layer.

3. The winding core of claim 2 wherein a split seam of said first paper shell member is offset from a split seam of said second paper shell member.

4. The winding core of claim 3 wherein said offset is 180 degrees.

5. The winding core of claim 3 wherein said offset is 90 degrees.

6. The winding core of claim 1 wherein said first preformed paper shell member is between approximately 90/1000 inch-200/1000 inch thick.

7. A method for manufacturing a winding core, said method comprising:

Providing an extruded wood fiber core member having an external diameter;

Splitting a first paper tube along a line parallel to said first tube's major axis, said first tube having an interior diameter less than the external diameter of said extruded wood fiber core member;

Applying an adhesive to said extruded wood fiber core member;

Opening said paper tube along said line and placing said paper tube around said extruded wood fiber core member; and Clamping said tube to said extruded wood fiber core member and allowing said adhesive to cure; and Affixing wooden staves parallel to the major axis of said extruded fiber core.

8. The method of claim 7 wherein further comprising:

Prior to affixing said wooden staves, splitting a second paper tube along a line parallel to said second tube's major axis, said second tube having an interior diameter less than the external diameter of said first tube;

Applying an adhesive to the exterior of said first paper tube;

Opening said second paper tube along said line parallel to said second tube's major axis and placing said paper tube around said first tube; and Clamping said tube to said first tube and allowing said adhesive to cure.

9. The method of claim 8 further comprising positioning said line parallel to said first tube's major axis offset from said line parallel to said second tube's major axis.

10. The method of claim 9 wherein said line parallel to said offset is 180 degrees.

11. The method of claim 9 wherein said offset is 90 degrees.

12. The method of claim 7 wherein said first paper tube has a wall thickness of between approximately 90/1000 inch 200/1000 inches.

* * * * *